US007891420B2

(12) United States Patent
Dale et al.

(10) Patent No.: US 7,891,420 B2
(45) Date of Patent: Feb. 22, 2011

(54) WELLBORE APPARATUS AND METHOD FOR COMPLETION, PRODUCTION AND INJECTION

(75) Inventors: Bruce A. Dale, Sugar Land, TX (US); Charles S. Yeh, Spring, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 144 days.

(21) Appl. No.: 11/990,422

(22) PCT Filed: Jul. 26, 2006

(86) PCT No.: PCT/US2006/028884

§ 371 (c)(1),
(2), (4) Date: Feb. 13, 2008

(87) PCT Pub. No.: WO2007/040737

PCT Pub. Date: Apr. 12, 2007

(65) Prior Publication Data

US 2009/0133874 A1 May 28, 2009

Related U.S. Application Data

(60) Provisional application No. 60/722,801, filed on Sep. 30, 2005.

(51) Int. Cl.
*E21B 43/08* (2006.01)

(52) U.S. Cl. ..... 166/231

(58) Field of Classification Search ..... 166/231, 166/232, 242.1

See application file for complete search history.

(56) References Cited

U.S. PATENT DOCUMENTS

| | | | | |
|---|---|---|---|---|
| 1,620,412 | A | 3/1927 | Tweeddale | |
| 3,709,293 | A * | 1/1973 | Layne et al. | 166/232 |
| 4,945,991 | A | 8/1990 | Jones | |
| 5,042,297 | A | 8/1991 | Lessi | |
| 5,095,990 | A | 3/1992 | Best et al. | |
| 5,113,935 | A | 5/1992 | Jones et al. | |
| 5,293,935 | A | 3/1994 | Arterbury et al. | |
| 5,476,143 | A | 12/1995 | Sparlin et al. | |
| 5,476,588 | A | 12/1995 | Nagaoka | |
| 5,515,915 | A | 5/1996 | Jones et al. | |
| 5,642,781 | A | 7/1997 | Richard | |
| 5,664,628 | A | 9/1997 | Koehler et al. | |
| 5,803,179 | A | 9/1998 | Echols et al. | |
| 5,881,809 | A | 3/1999 | Gillespie et al. | |

(Continued)

OTHER PUBLICATIONS

European Search Report No. 113121 for 2005UR033, dated Mar. 20, 2006, 3 pages.

*Primary Examiner*—Daniel P Stephenson

(57) ABSTRACT

A method and apparatus associated with the production of hydrocarbons is disclosed. In one embodiment, an apparatus includes a tubular member having a central opening within an internal portion of the tubular member, wherein the central opening allows hydrocarbons to flow through the tubular member. Also, the tubular member includes openings between the central opening and a region external to the tubular member. In addition to the tubular member, at least two adjacent wire segments are disposed around the tubular member. The at least two adjacent wire segments create at least two flow paths to the central opening. Also, the at least two adjacent wire segments form at least two openings configured to prevent particles greater than a specific size from entering the openings in the tubular member.

51 Claims, 7 Drawing Sheets

U.S. PATENT DOCUMENTS

| | | | |
|---|---|---|---|
| 5,938,925 | A | 8/1999 | Hamid et al. |
| 6,089,316 | A | 7/2000 | Spray |
| 6,125,932 | A | 10/2000 | Hamid et al. |
| 6,227,303 | B1 | 5/2001 | Jones |
| 6,298,914 | B1 | 10/2001 | Spray et al. |
| 6,405,800 | B1 | 6/2002 | Walker et al. |
| 6,494,265 | B2 | 12/2002 | Wilson et al. |
| 6,554,064 | B1 | 4/2003 | Restarick et al. |
| 6,557,634 | B2 | 5/2003 | Hailey, Jr. et al. |
| 6,675,245 | B1 | 1/2004 | Schmidt |
| 6,684,951 | B2 | 2/2004 | Restarick et al. |
| 6,715,544 | B2 | 4/2004 | Gillespie et al. |
| 6,745,843 | B2 | 6/2004 | Johnson et al. |
| 6,752,206 | B2 | 6/2004 | Watson et al. |
| 6,837,308 | B2 | 1/2005 | Michel |
| 6,848,510 | B2 | 2/2005 | Bixenman et al. |
| 7,234,518 | B2 | 6/2007 | Smith |
| 2005/0034860 | A1 | 2/2005 | Lauritzen |
| 2007/0114020 | A1 | 5/2007 | Brekke |

* cited by examiner

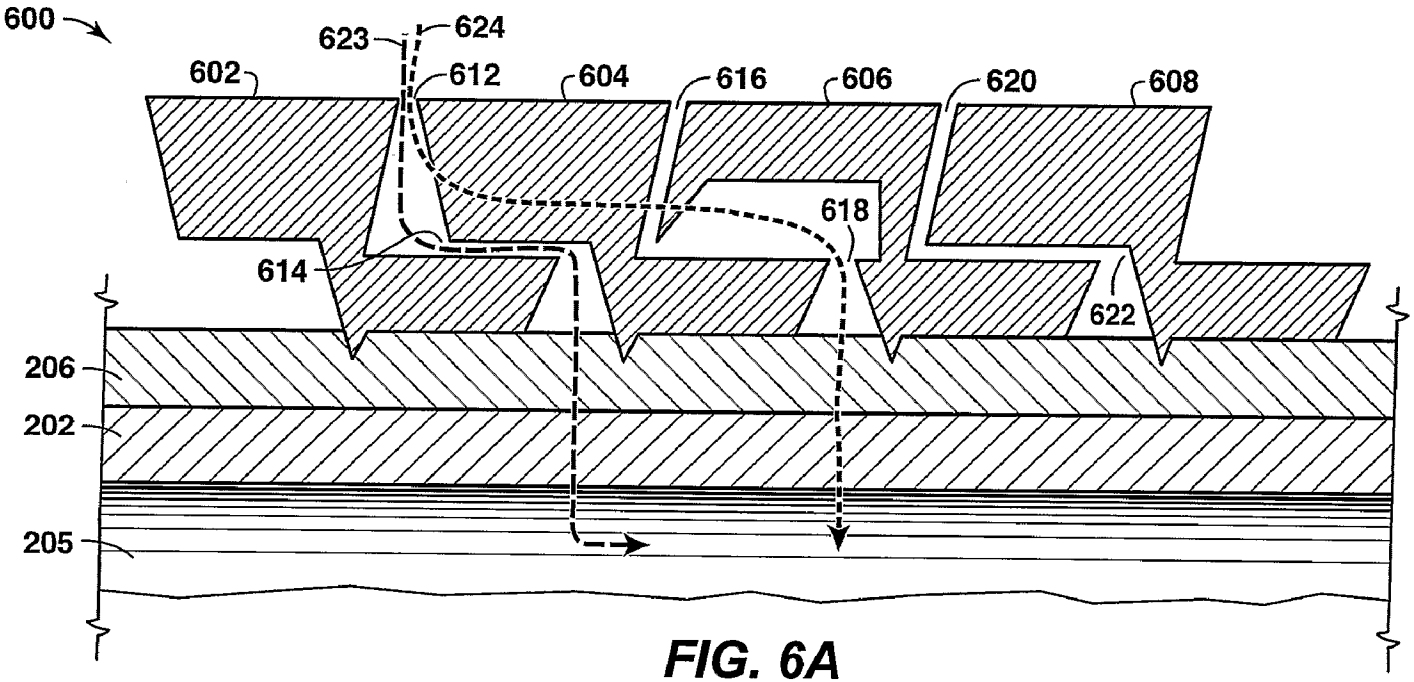
FIG. 6A
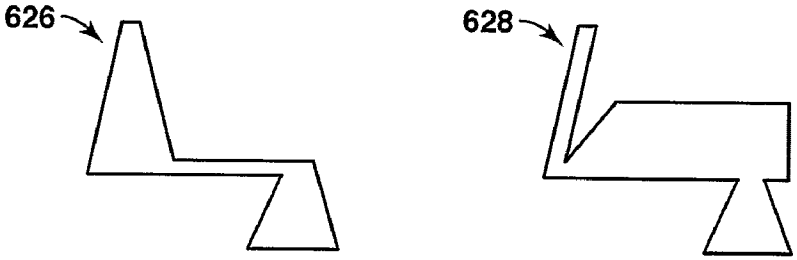
FIG. 6B
FIG. 6C
FIG. 6D

WELLBORE APPARATUS AND METHOD FOR COMPLETION, PRODUCTION AND INJECTION

CROSS REFERENCE TO RELATED APPLICATIONS

This application is the National Stage of International Application No. PCT/US06/28884, filed 26 Jul. 2006, which claims the benefit of U.S. Provisional Application 60/722,801, filed 30 Sep. 2005.

FIELD OF THE INVENTION

This invention relates generally to an apparatus and method for use in wellbores. More particularly, this invention relates to a wellbore apparatus and method suitable for fluid production and gravel packing through redundant sand control in a single wrapping process.

BACKGROUND

This section is intended to introduce the reader to various aspects of art, which may be associated with exemplary embodiments of the present invention, which are described and/or claimed below. This discussion is believed to be helpful in providing the reader with information to facilitate a better understanding of particular techniques of the present invention. Accordingly, it should be understood that these statements are to be read in this light, and not necessarily as admissions of prior art.

The production of hydrocarbons, such as oil and gas, has been performed for numerous years. To produce these hydrocarbons, a production system may utilize various devices, such as sand screens and other tools, for specific tasks within a well. Typically, these devices are placed into a wellbore completed in either cased-hole or open-hole completion. In cased-hole completions, wellbore casing is placed in the wellbore and perforations are made through the casing into subterranean formations to provide a flow path for formation fluids, such as hydrocarbons, into the wellbore. Alternatively, in open-hole completions, a production string is positioned inside the wellbore without wellbore casing. The formation fluids flow through the annulus between the subsurface formation and the production string to enter the production string.

However, when producing hydrocarbons from subterranean formations, it becomes more challenging because of the location of certain subterranean formations. For example, some subterranean formations are located in ultra-deep water, at depths that extend the reach of drilling operations, in high pressure/temperature reservoirs, in long intervals, at high production rate, and at remote locations. As such, the location of the subterranean formation may present problems that increase the individual well cost dramatically. That is, the cost of accessing the subterranean formation may result in fewer wells being completed for an economical field development. Accordingly, well reliability and longevity become design considerations to avoid undesired production loss and expensive intervention or workovers for these wells.

As an example, when producing formation fluids from subterranean formations located in deep water, it is possible to produce solid material, such as sand, along with the formation fluids because the formations are poorly consolidated or the formations are weakened by downhole stress due to wellbore excavation and formation fluid withdrawal. Sand control devices are usually installed downhole across these formations to retain solid material, but allow fluids to be produced. Loss of sand control may result in sand production at the surface, downhole equipment damage, reduced well productivity and/or loss of the well. Under the increasingly harsh environments, sand control devices are more susceptible to damage due to high stress, erosion, plugging, compaction/subsidence, etc. Such damage may occur to the sand control devices during transportation, installation, completion, injection, production, or stimulation. In fact, damage to the sand control devices is difficult to predict or prevent. As a result, sand control devices are generally utilized with other methods to manage the production of sand from the subterranean formation.

One of the most commonly used methods to control sand is a gravel pack. Gravel packing a well involves placing gravel or other particulate matter around a sand control device that is coupled to the production string. The sand control device may have openings or may be wrapped by a screen. For instance, in an open-hole completion, a gravel pack is typically positioned between the wall of the wellbore and a screen that surrounds a perforated base pipe. Alternatively, in a cased-hole completion, a gravel pack is positioned between a casing string having perforations and a well screen that surrounds a perforated base pipe. Regardless of the completion type, formation fluids flow from the subterranean formation into the production string through the gravel pack and sand control device.

Other sand control methods utilize may include standalone screens and frac packs to address the sand production problem. Recent technology advance in sand control has been focused on monitoring downhole conditions, improving sand retention, increasing flow performance, and reducing erosion potential. For instance, screens may be designed to enhance sand retention efficiency and flow performance. Similarly, the openings in screens may be adjusted to reduce erosion. Also, sensors may be installed in hollow wires or rods in a sand screen to monitor pressure, temperature, density, etc. to provide information about sand control performance.

Currently, sand control equipment includes little, if any, redundancy that addresses problems with failures resulting in flow impairment. In many instances, the ability of a well to produce at or near its design capacity is sustained by only a "single" barrier to the impairment mechanism. That is, a sand screen may be the only device that is utilized to control sand in unconsolidated formations. As a result, any damage to the installed sand screen may result in the production of sand along with the hydrocarbons. If a gravel pack is installed, screen damage may cause both gravel and sand production. Solids production may result in downhole equipment erosion, productivity impairment, sand handling challenges at the surface, and/or partial or complete loss of well productivity. As a result, workovers or sidetracks are eventually required. Thus, the overall system reliability for well completions has great uncertainty.

Accordingly, the need exists for a more reliable well completion apparatus and method to provide redundancy for screens, alternative flow paths inside the screens, and self-mitigating functionality, which includes compartmentalization to address the uncertainty in mechanical damage of sand control screen.

Other related material may be found in at least U.S. Pat. No. 4,945,991; U.S. Pat. No. 5,095,990; U.S. Pat. No. 5,113,935; U.S. Pat. No. 5,293,935; U.S. Pat. No. 5,476,588; U.S. Pat. No. 5,515,915; U.S. Pat. No. 5,642,781; U.S. Pat. No. 5,642,781; U.S. Pat. No. 5,938,925; U.S. Pat. No. 6,125,932; U.S. Pat. No. 6,227,303; U.S. Pat. No. 6,554,064; U.S. Pat.

No. 6,684,951; U.S. Pat. No. 6,715,544; U.S. Pat. No. 6,745,843; and U.S. Patent Application Publication No. 2005/0034860.

SUMMARY

In one embodiment, an apparatus associated with the production of hydrocarbons is disclosed. The apparatus includes a tubular member having a central opening within an internal portion of the tubular member, wherein the central opening allows hydrocarbons to flow through the tubular member. Also, the tubular member includes openings between the central opening and a region external to the tubular member. In addition to the tubular member, at least two adjacent wire segments are disposed around the tubular member. The at least two adjacent wire segments create at least two flow paths to the central opening. Also, the at least two adjacent wire segments form at least two openings configured to prevent particles greater than a specific size from entering the openings in the tubular member.

In a first alternative embodiment, a sand control device is disclosed. The sand control device includes a plurality of wire segments disposed around the central opening. At least two adjacent wire segments of the plurality of wire segments create at least one circumferential channel between the at least two adjacent wire segments and around the central opening. Further, at least two adjacent wire segments form at least two openings configured to prevent particles greater than a specific size from entering the central opening.

In a second alternative embodiment, a system associated with production of hydrocarbons is disclosed. The system includes a wellbore utilized to produce hydrocarbons from a subsurface reservoir. Also, the system includes a production tubing string disposed within the wellbore. Finally, the system includes at least one sand control device coupled to the production tubing string and disposed within the wellbore. The at least one sand control device includes a plurality of wire segments disposed around a central opening, wherein at least one pair of adjacent wire segments of the plurality of wire segments create a circumferential channel between the at least one pair of adjacent wire segments and the central opening. Further, the at least one pair of adjacent wire segments form at least two redundant openings to prevent particles greater than a specific size from entering the central opening.

In a third alternative embodiment, a method associated with the production of hydrocarbons is described. The method includes providing a sand control device having wire segments disposed around a central opening. At least one pair of adjacent wire segments of the wire segments creates a circumferential channel between the pair of adjacent wire segments and around the central opening. Also, the at least one pair of adjacent wire segments form at least two redundant openings to prevent particles greater than a specific size from entering the central opening. Then, the sand control device is disposed within a wellbore.

In a fourth alternative embodiment, a method of manufacturing a sand control device is described. The method includes forming wire segments. Then, the wire segments are wrapped around a central opening in a single wrap process. At least one pair of adjacent wire segments create a circumferential channel between the at least one pair of adjacent wire segments and around the central opening. Also, the at least one pair of adjacent wire segments form at least two redundant openings configured to prevent particles greater than a specific size from entering the central opening.

BRIEF DESCRIPTION OF THE DRAWINGS

The foregoing and other advantages of the present technique may become apparent upon reading the following detailed description and upon reference to the drawings in which:

FIGS. 6A-6D are another exemplary embodiment of channels formed in wire segments in the sand control device of FIG. 1 in accordance with certain aspects of the present techniques.

DETAILED DESCRIPTION

In the following detailed description, the specific embodiments of the present invention are described in connection with its preferred embodiments. However, to the extent that the following description is specific to a particular embodiment or a particular use of the present techniques, it is intended to be illustrative only and merely provides a concise description of the exemplary embodiments. Accordingly, the invention is not limited to the specific embodiments described below, but rather; the invention includes all alternatives, modifications, and equivalents falling within the true scope of the appended claims.

The present technique includes a sand control device that may be utilized in a completion, production, or injection system to enhance well completion, e.g., gravel pack, and/or enhance production of hydrocarbons from a well and/or enhance the injection of fluids or gases into the well. Under the present technique, which may be referred to as a "Mazewire system," wire segments have specific geometric configurations to provide redundancy and additional flow paths through the wire segments of a sand control device. In addition to the specific geometric configurations of the wire segments, different types of wire segments may be utilized together to form channels having partitions, compartments, and baffles, which manage the flow of fluids through the wire segments. That is, wire segments may be utilized to provide redundancy, baffling (staggering), and compartmentalization for a sand control device via the wire segments of wire-wrapped screens. Accordingly, wire segments, which may be a continuous wire or individual wires coupled together, may form channels with combinations of various geometries. By wrapping these around axial rods on a tubular member with a central opening, the openings between two adjacent wire segments may provide multiple channels or flow paths in radial, circumferential, axial, helical or mixed directions. As such, the present techniques may be used in well completions with or without a gravel pack for flow control, hydrocarbon production and/or fluid injection.

Further, it should be noted that International Patent Application No. PCT/US04/01599 describes a wellbore apparatus that combines redundant, baffled (staggered), and compartmentalized sand control to self-mitigate screen damage due to erosion, compaction, and other mechanical causes. However, in the present techniques, wire segments having different geometric patterns are used to provide redundancy, baffling (staggering), and compartmentalization for sand control within a sand control device. Accordingly, these wire segments, which may be a continuous wire or individual wire segments, may self-mitigate screen damage due to erosion, compaction, and other mechanical causes. As such, the wire segments may enhance well reliability and longevity under increasingly challenging downhole conditions.

Figure 1:
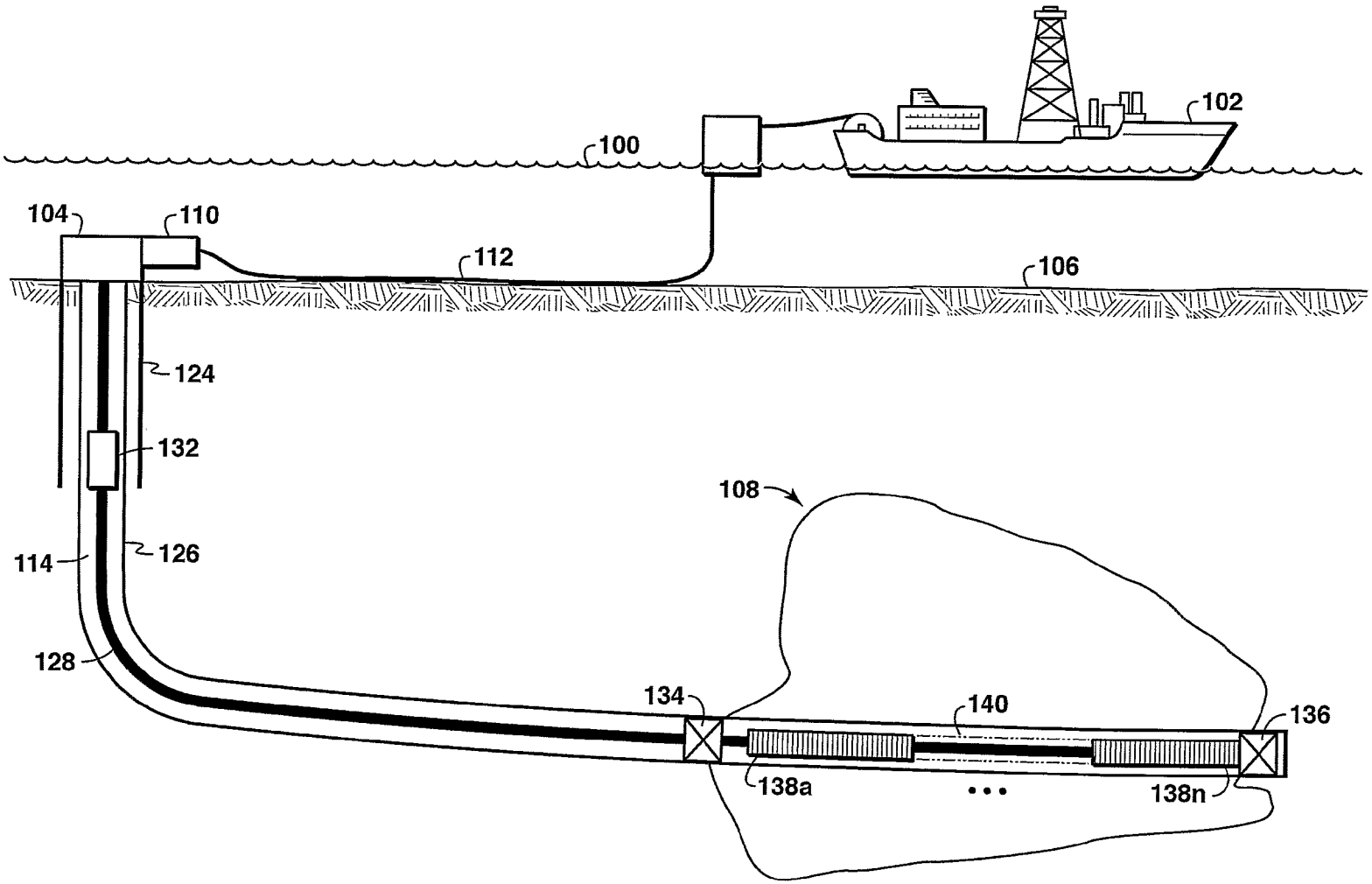
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. Through this subsea tree 104, the floating production facility 102 accesses a subsurface formation 108 that includes hydrocarbons, such as oil and gas. Beneficially, the devices, such as sand control devices 138*a*-138*n*, may be utilized to prevent sand production and enhance the production of hydrocarbons from this subsurface formation 108. As may be appreciated, the number n may include any integer number. However, it should be noted that the production system 100 is illustrated for exemplary purposes and the present techniques may be useful in the production or injection of fluids from any subsea, platform or land location.

The floating production facility 102 is configured to monitor and produce hydrocarbons from the subsurface formation 108. The floating production facility 102 may be a floating vessel capable of managing the production of fluids, such as hydrocarbons, from subsea wells. These fluids may be stored on the floating production facility 102 and/or provided to tankers (not shown). To access the subsurface formation 108, the floating production facility 102 is coupled to a subsea tree 104 and control valve 110 via a control umbilical 112. The control umbilical 112 may include production tubing for providing hydrocarbons from the subsea tree 104 to the floating production facility 102, control tubing for hydraulic or electrical devices, and a control cable for communicating with other devices within the wellbore 114.

To access the subsurface formation 108, the wellbore 114 penetrates the sea floor 106 to a depth that interfaces with the subsurface formation 108. As may be appreciated, the subsurface formation 108 may include various layers of rock that may or may not include hydrocarbons and may be referred to as zones. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the wellbore 114, the production system 100 may also include different equipment to provide access to the subsurface formation 108. For instance, a surface casing string 124 may be installed from the sea floor 106 to a location at a specific depth beneath the sea floor 106. Within the surface casing string 124, an intermediate or production casing string 126, which may extend down to a depth near the subsurface formation 108, may be utilized to provide support for walls of the wellbore 114. The surface and production casing strings 124 and 126 may be cemented into a fixed position within the wellbore 114 to further stabilize the wellbore 114. Within the surface and production casing strings 124 and 126, a production tubing string 128 may be utilized to provide a flow path through the wellbore 114 for hydrocarbons and other fluids. Along this flow path, a subsurface safety valve 132 may be utilized to block the flow of fluids from the production tubing string 128 in the event of rupture or break above the subsurface safety valve 132. Further, packers 134 and 136 may be utilized to isolate specific zones within the wellbore annulus from each other.

In addition to the above equipment, other devices or tools, such as sand control devices 138*a*-138*n* and a gravel pack 140, may be utilized to manage the flow of fluids and particles into the production tubing string 128. The sand control devices 138*a*-138*n*, which may herein be referred to as sand control device(s) 138, may include wire-wrapped screens, membrane screens, expandable screens and/or wire-mesh screens. For exemplary purposes, the sand control devices 138 are herein described as being wire-wrapped screens that include various wire segments. Also, around the sand control devices 138, a gravel pack or natural sand pack 140 may be disposed to provide additional mechanism to manage the flow of fluids and particles into the production tubing string 128. The sand control devices 138 may manage the flow of hydrocarbons from the subsurface formation 108 to the production tubing string 128.

Typically, a wire-wrapped screen includes a continuous wire spirally wrapped on a set of circularly spaced and axially extended rods. The wire is attached to the axial rods by welding at each contact point. The winding process is designed and controlled to attain the desired opening size between two adjacent wires. The wire wrapped screen may be slipped on a perforated tubular member or base pipe for a slip-on wire-wrapped screen or wrapped directly onto the base pipe in a direct wire-wrapped screen, as is known in the art. The wire segments form a screen that prevents particles, such as sand, sand grains or other solid particles greater than a specific size, from entering the production tubing string 128. Accordingly, exemplary wire segments utilized in a sand control device 138 is shown in greater FIGS. 2A and 2B.

Figure 2B:
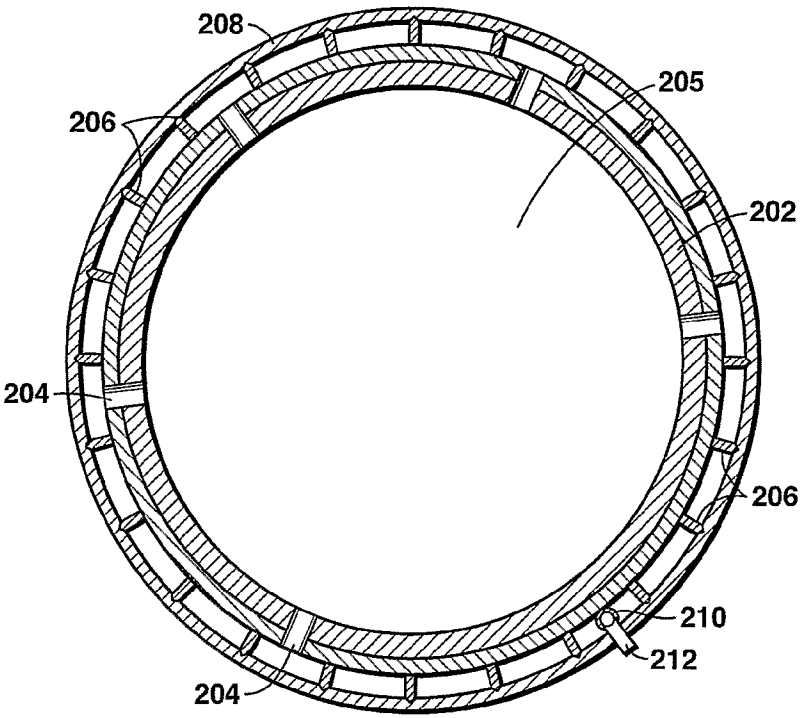
FIGS. 2A and 2B are an exemplary embodiment of a portion of a sand control device utilized in the production system of FIG. 1 in accordance with certain aspects of the present techniques.
Figure 2A:
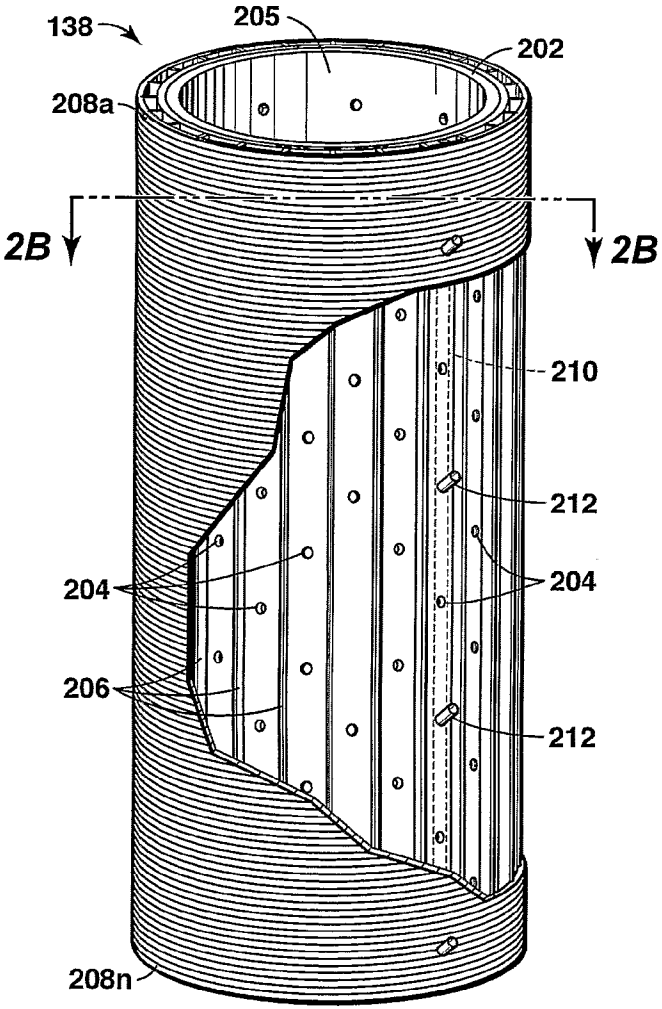

FIGS. 2A and 2B are an exemplary embodiment of a portion of a sand control device, such as one of the sand control devices 138*a*-138*n*, utilized in the production system 100 of FIG. 1 in accordance with certain aspects of the present techniques. Accordingly, FIGS. 2A and 2B may be best understood by concurrently viewing FIG. 1. In FIG. 2A, the sand control device 138 includes various components that are utilized to manage the flow of fluids and particles into or out of the production tubing string 128. For instance, the sand control device 138 may include a tubular member or base pipe 202 having one or more openings 204 that provide a flow path from outside the base pipe 202 to a central opening 205 within the base pipe 202.

To provide sand control, a screen of wire segments 208*a*-208*n* is disposed around one or more axial rods 206 may be utilized. The axial rods 206, which may include any number of axial rods 206, may be secured to the base pipe 202 via welds or other similar techniques. The axial rods 206 provide support to one or more wire segments 208*a*-208*n*, which may be referred to as wire segments 208. These wire segments 208 prevent or restrict the flow of particles, such as sand, into the central opening 205 of the base pipe 202, as discussed below in greater detail. The wire segments 208 may be continuously wrapped and welded on the axial rods 206. The resulting hollow, cylindrical wire-rod embodiment is slipped on the base pipe 202 and secured to the base pipe 202 by welding metal rings at the two opposite ends. The metal rings also seal the open ends between wire segments 208, axial rods 206, and base pipe 202. Alternatively, the wire segments 208 may be direct-wrapped on the axial rods 206, which are disposed along the external face of base pipe 202. The direct-wrap secures wire segments 208 and axial rods 206 to the base pipe 202. The metal rings are welded at two opposite ends to seal the open ends between wire segments 208, axial rods 206, and base pipe 202. Accordingly, these wire segments 208 may be either slip-on or direct wrap wire segments that are attached to the axial rods 206, which are known methods of attaching wire segments in a sand control device. Also, the wire segments 208 and axial rods 206 may be partially or completely coated with an erosion resistance material (e.g., nickel-based thermal spray or metal shields) to further prevent damage.

In addition, alternate path technology may also be utilized with the axial rods 206 and wire segments 208. The alternate path technology may include a shunt tube 210 that is disposed on the outside of wire segments 208, which are described in U.S. Pat. Nos. 4,945,991 and 5,113,935, or between the base pipe 202 and the wire segments 208, which are described in U.S. Pat. Nos. 5,515,915 and 6,227,303. The shunt tube 210 may include one or more nozzles 212 positioned along the length of the shunt tube 210. If the shunt tube 210 is positioned between the base pipe 202 and the wire segments 208 (FIGS. 2A and 2B), the nozzles 212 may extend beyond the wire segments 208 to provide a flow path from the shunt tube 210 to a location external to the wire segments 208, such as a wellbore annulus. For an alternative perspective of the partial view of the sand control device 138, a cross sectional view of the various components along the line 2B is shown in FIG. 2B To enhance the sand control device, the wire segments 208 may be wrapped around the base pipe 202 in various directions and with varying pitch. For instance, a wire-wrapped screen may include wire segments wrapped around the base pipe 202 at a constant pitch or at varying pitches. The constant pitch may be utilized to prevent certain sized particles from entering the production tubing string 128, while the varied pitch wire segments 208 may be utilized to manage the amount of fluid flow through various portions of the wire segments 208. In addition, the direction of the wire segments may be adjusted to provide channels or flow paths within the wire segments 208, as discussed below in greater detail. This variation in direction may form flow paths that are perpendicular to the fluid flow through the base pipe 202, parallel to the fluid flow through the base pipe 202, or other angular variations relative to the fluid flow through the base pipe 202.

Further, variations in the geometry of the wire segments 208 may form unique openings and channels within the wire segments 208. The openings may be described as designing openings and restrictive openings. Designing openings may be utilized for sand control and well performance purposes to retain sand grains and allow fluid and fines (silts and clays) to pass through the openings. Restrictive openings may be utilized to retain sand grains and restrict the flow of fluids and fines. Depending upon the magnitude of restriction, restrictive openings may allow no flow, minimum flow, and/or diminishing flow due to fines plugging, as noted above. The restriction may be furnished by wrapping the wire segments 208 to have a narrower opening, lengthy opening, tortuous opening, keystone shape opening and/or any combination thereof.

By utilizing various geometric patterns and combinations of design and restrictive openings, the wire segments 208 may be utilized to construct tortuous flow paths or channels through adjacent pairs of wire segments 208. For instance, because restrictive openings are stronger and more erosion resistant than the designing openings, restrictive openings may be arranged to restrict flow along a channel, which may be referred to as a partition. In particular, openings in each channel of the wire segments may be characterized by having at least one restrictive opening and at least one designing opening. Alternatively, any two adjacent openings may include different combinations of design and restrictive openings to stagger or baffle the fluid flowing into the channels. Accordingly, the use of different openings and geometries in the wire segments 208 may provide additional flow paths and redundancy for the sand control device.

As an example, fluids flow from the subsurface formation 108 into the wellbore 114 and through openings formed by the wire segments 208. With the channels formed in the wire segments 208, fluids may flow through the channels formed in the wire segments 208 and/or may travel directly into the central opening 205 through the openings 204 in the base pipe 202. From the central opening 205, fluid flows through to the floating production facility 102 via the production tubing string 128. Typically, in a damaged sand control device, sand may cause sanding-up of the production tubing string 128 and/or the wellbore 114, downhole equipment damage, or massive sand production at the surface.

However, because of the configuration and geometric patterns of the wire segments 208, particles, such as sand, may be retained by the channels, openings, or compartments formed by the wire segments 208. Accordingly, if one pair of wire segments 208 is eroded or damaged, fluid along with sand may pass into one of the channels associated with that pair of the wire segments 208. Within the channel, the momentum of the incoming sand grains is reduced in the channel due to collisions with the walls formed by the wire segments 208. Depending on both magnitude and direction of sand/fluid momentum, sand grains may be captured by restrictive openings, captured by neighboring staggered designing openings, lose kinetic energy when traveling further along the channel, or stopped and entrapped at a partition formed by the wire segments 208. As additional sand grains are accumulated back to the eroded location along the channel, the flow resistance rises and the sand/fluid flow is diverted into another non-eroded portion of the wire segments 208. That is, the flow of fluids at the eroded portion of the wire segments 208 is reduced or shut off, while well production continues through other flow paths or channels within the wire segments 208. As such, the wire segments 208 may self-mitigate damage to the sand control device at various locations without well intervention.

Figure 3:
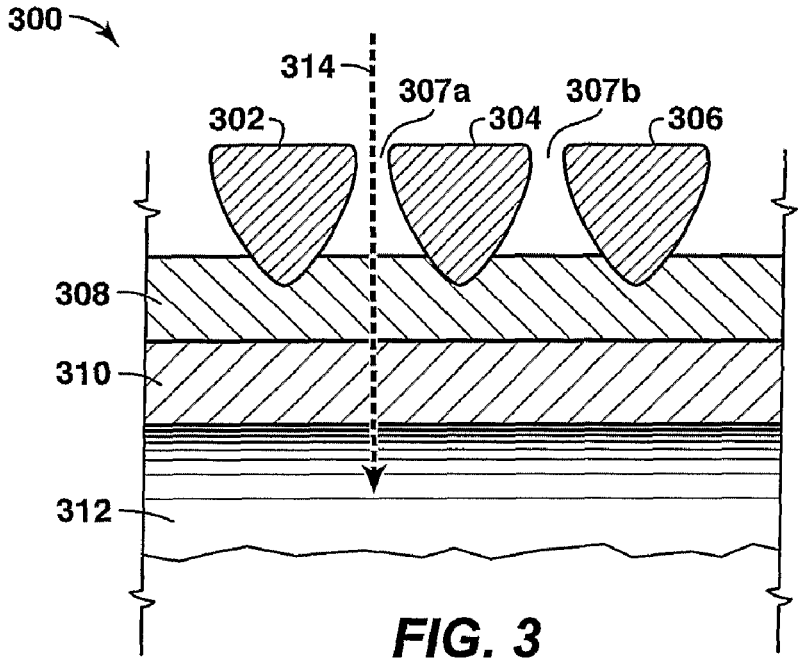
FIG. 3 is an exemplary embodiment of wire segments coupled to an axial rod in a sand control device.

As a specific example, FIG. 3 illustrates an exemplary embodiment of wire segments coupled to an axial rod in a sand control device. In this embodiment, which is herein referred to by reference numeral 300, a base pipe 310 having a central opening 312 is coupled to an axial rod 308 and wire segments 302-306. The wire segments 302-306 may have a keystone shape with a fluid openings or gaps 307*a* and 307*b* between the wire segments 302-306. Fluid or particles may flow along a fluid flow path 314 through the openings 307*a* and 307*b* between the wire segments 302-306. Then, the fluid or particles may flow through openings (not shown) in the base pipe 310 to enter the central opening 312. As such, particles carried by the fluid may block or strike the wire segments 302-306, which may result in mechanical damage to the wire segments 302-306. Another example of mechanical damage to the wire segments 302-306 may be caused by compaction and subsidence of subsurface formation rocks. Excessive load on the screen during transportation or installation may also result in mechanical damage.

In the example of FIG. 3, the openings 307*a* and 307*b* of the wire segments 302-306 are the only mechanism for preventing particles from entering the central opening 312 of the base pipe 310. If one of the fluid openings 307*a* and 307*b* between the wires 302-306 is eroded or damaged, the wire segments 302-306 may fail to prevent particles from entering the central opening 312 of the base pipe 310 and the production tubing string 128. That is, the sand control device that utilizes these wire segments 302-306 may produce excessive amounts of solid particles, such as sand, if one of the openings 307*a* and 307*b* fails.

Figure 4A:
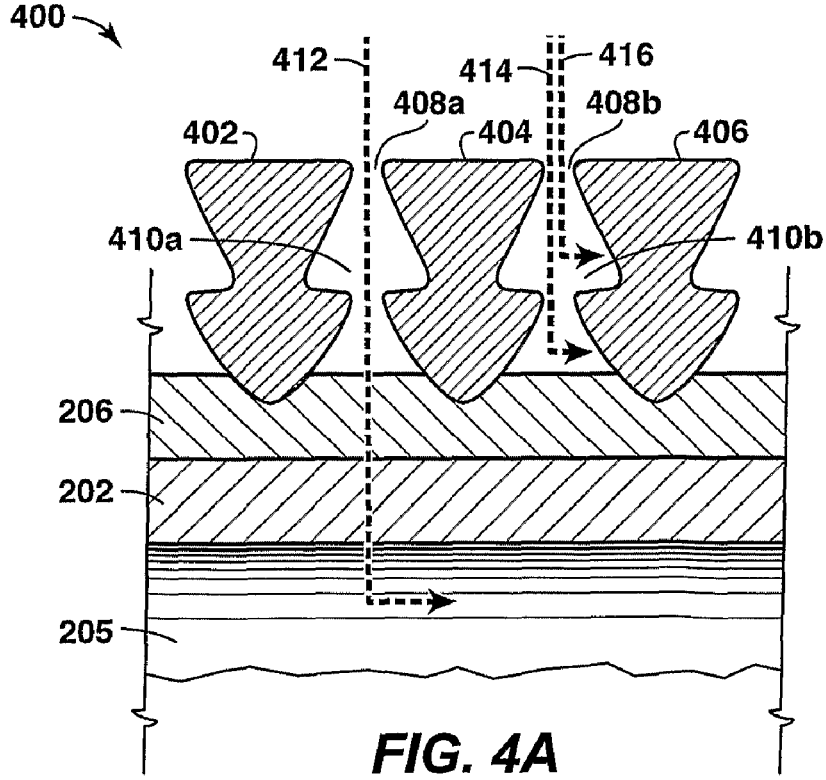
FIGS. 4A-4D are exemplary embodiments of wire segments in the sand control device of FIG. 1 in accordance with certain aspects of the present techniques.

However, under the present techniques, the wire segments of FIGS. 4A-4D may provide redundancy for the wire segments and additional flow paths within the wire segments. FIG. 4A is an exemplary embodiment of wire segments coupled to one of the axial rods 206 in the sand control device 138 of FIG. 1 in accordance with certain aspects of the present techniques. In this embodiment, which is herein referred to by reference numeral 400, the base pipe 202 having a central opening 205 is coupled to the axial rod 206 and wire segments 402-406, which may be examples of the wire segments 208*a*-208*n*. The wire segments 402-406 may have double stacked keystone patterns with fluid openings or gaps 408*a*, 408*b*, 410*a* and 410*b* between the wire segments 402-406. A lobe on the lower keystone portion of each of the wire segments 402-406 may be utilized to secure the wire segments 402-406 to the axial rod 206. These keystone portions may be secured via welding the wire segments 402-406 to the axial rod 206 or other similar techniques.

In this pattern, redundancy and additional flow paths are provided by the wire segments 402-406. As shown along the fluid flow path 412, redundancy is provided by the double stacked keystone pattern, which provides two restrictive openings 408*a* and 410*a* or 408*b* and 410*b* between each pair of wire segments 402-406. Indeed, the openings 408*a*, 408*b*, 410*a* and 410*b* in the wire segments 402-406 have inverse keystone geometry that may minimize plugging. The openings 408*a*, 408*b*, 410*a* and 410*b* allow fluid to pass through, but prevent particles of specific sizes from passing through. Further, if the wire segments 402-406 are disposed with in an angular direction relative to the fluid flow through the base pipe 202, fluid flow paths 414 and 416 may be utilized to provide a tortuous fluid flow path through the wire segments 402-406. As such, two flow paths are provided through the wire segments 402-406 along with the fluid flow path 412 into the central opening 205.

Figure 4B:
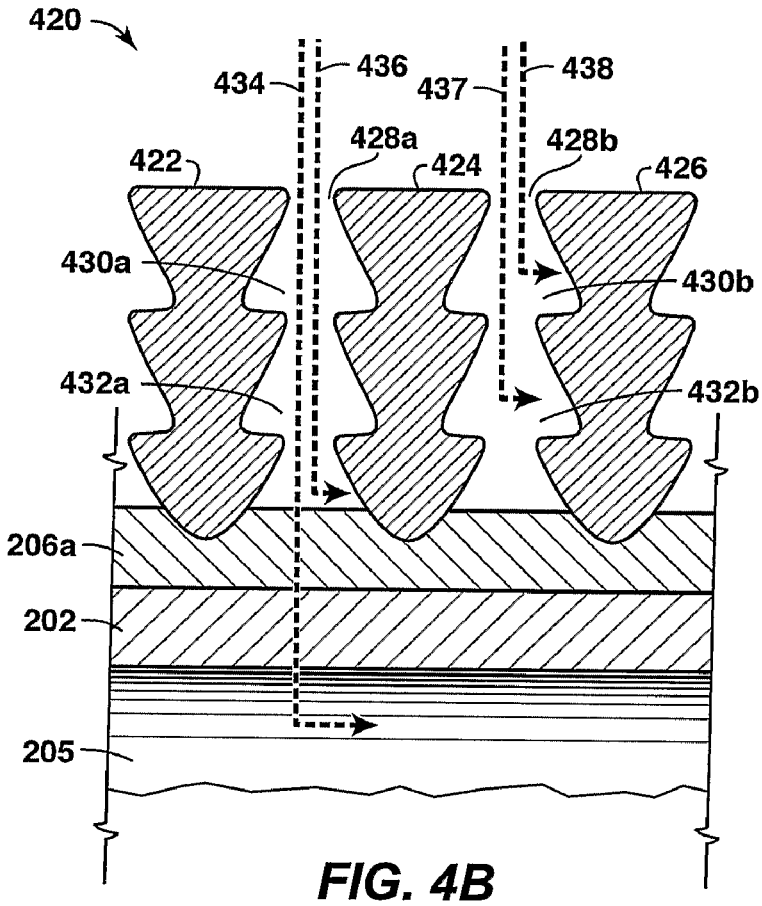

In an alternative embodiment, FIG. 4B is an alternative exemplary embodiment of wire segments coupled to an axial rod 206 in the sand control device 138 of FIG. 1 in accordance with certain aspects of the present techniques. In this embodiment, which is herein referred to by reference numeral 420, the base pipe 202 having a central opening 205 is coupled to the axial rod 206 and wire segments 422-426, which may be another example of the wire segments 208*a*-208*n*. The wire segments 422-426 may have triple stacked keystone patterns with fluid openings or gaps 428*a*, 428*b*, 430*a*, 430*b*, 432*a* and 432*b* between the wire segments 422-426 to provide more flow paths than the embodiment of FIG. 4A. Similar to the discussion above, a lobe on the bottom portion of the keystone portions may secure the wire segments 422-426 to the axial rod 206.

In this pattern, redundancy and additional flow paths are again provided by the wire segments 422-426. As shown along the fluid flow path 434, redundancy is provided by the triple stacked keystone pattern, which provides three restrictive openings 428*a*, 430*a* and 432*a*, and 428*b*, 430*b* and 432*b* between each pair of wire segments 422-426. Again, the inverse keystone geometry may minimize plugging of the wire segments 422-426. In addition, if the wire segments 422-426 are disposed with in an angular direction relative to the fluid flow through the base pipe 202, fluid flow paths 436, 437 and 438 may be utilized to provide a tortuous path through the wire segments 422-426. As such, three flow paths 436-438 are provided through the wire segments 422-426 along with the fluid flow path 434 into the central opening 205.

Figure 4C:
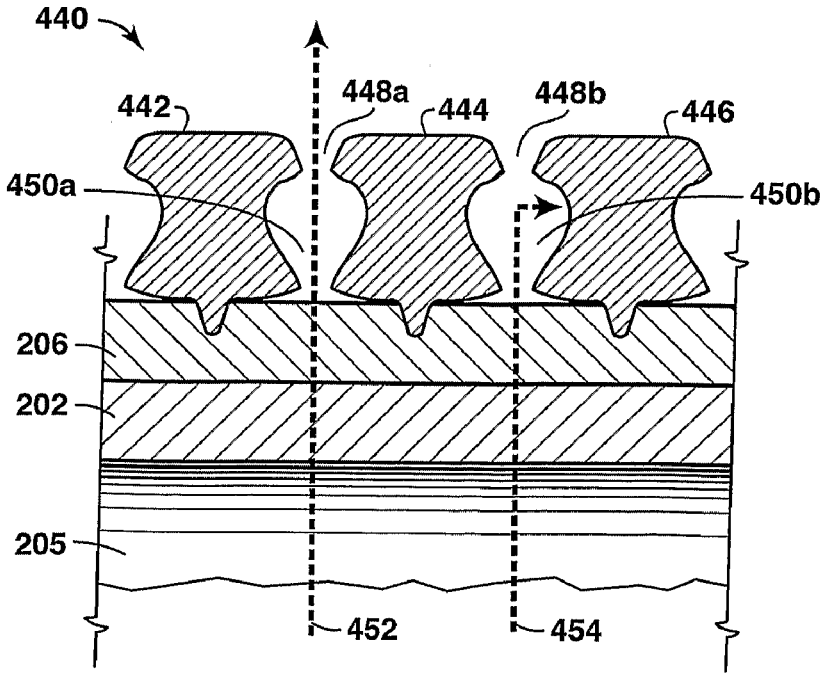

In a second alternative embodiment, FIG. 4C is a second alternative exemplary embodiment of wire segments coupled to an axial rod 206 in the sand control device 138 of FIG. 1 in accordance with certain aspects of the present techniques. In this embodiment, which is herein referred to by reference numeral 440, the base pipe 202 having a central opening 205 is coupled to the axial rod 206 and wire segments 442-446, which may be another example of the wire segments 208*a*-208*n*. The wire segments 442-446 may have hyperboloidal patterns with fluid openings or gaps 448*a*, 448*b*, 450*a* and 450*b* between the wire segments 442-446 to provide dual redundant sand control with inverse keystone openings in the injection direction. A bottom lobe on each of the wire segments 442-446 may be utilized to secure the wire segments 442-446 to the axial rod 206, which may include welding the wire segments 442-446 to the axial rod 206.

In this pattern, redundancy and additional flow paths are provided by the wire segments 442-446. As shown along the fluid flow path 452, redundancy is provided by the hyperboloidal pattern, which provides two restrictive openings 448*a*, 448*b*, 450*a* and 450*b* between each pair of wire segments 442-446. Because the keystone pattern is susceptible to plugging, the hyperboloidal pattern provides dual redundant sand control with inverse keystone openings in the injection direction, along the flow path 452. In addition, if the wire segments 442-446 are disposed with in an angular direction relative to the fluid flow through the base pipe 202, a fluid flow path 454 may be utilized to provide a tortuous path through the wire segments 442-446. As such, an additional flow path is provided through the wire segments 442-446 along with the fluid flow path 452 into the central opening 205.

Figure 4D:
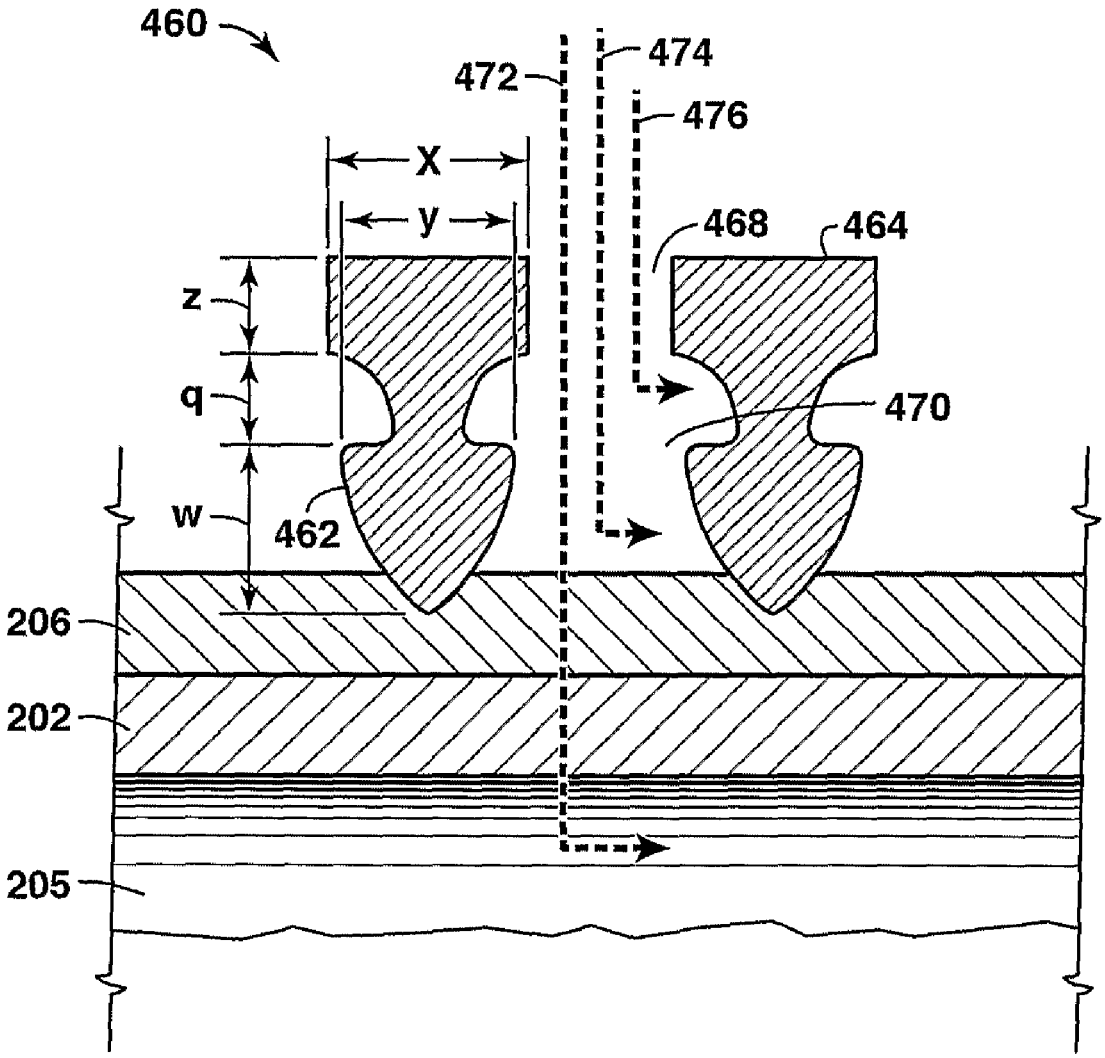

In FIG. 4D, a third alternative exemplary embodiment of wire segments coupled to an axial rod 206 in the sand control device 138 of FIG. 1 in accordance with certain aspects of the present techniques is shown. In this embodiment, which is herein referred to by reference numeral 460, the base pipe 202 having a central opening 205 is coupled to the axial rod 206 and wire segments 462 and 464, which may be another example of the wire segments 208*a*-208*n*. The wire segments 462 and 464 may have a lower or keystone portion stacked partial hyperboloidal or middle portion and an upper or rectangular portion to form a unique geometric pattern. This geometric pattern forms fluid openings or gaps 468 and 470 between the wire segments 462 and 464. The upper portion forms a restrictive path that is flat, while the middle and lower portions provide flow paths through the wire segments 462 and 464. Because the bottom portion has a keystone pattern on each of the wire segments 462 and 464, it may be utilized to secure the wire segments 462 and 464 to the axial rod 206. As noted above, these may be secured via welding the wire segments 462 and 464 to the axial rod 206 or other similar techniques.

In this geometric pattern, redundancy and additional flow paths are provided by the wire segments 462 and 464. As shown along the fluid flow path 472, redundancy is provided by the geometric pattern, which provides a first restrictive opening 468 and a second designing opening 470 between each pair of wire segments 462 and 464. In addition, if the wire segments 462 and 464 are positioned in an angular direction relative to the fluid flow through the base pipe 202, fluid flow path 476 may be utilized to provide an additional flow path through the wire segments 462 and 464. That is a circumferential channel may be formed within the wire segments 462 and 464. As such, additional flow path 476 is provided through the wire segments 462 and 464 along with the fluid flow path 472 into the central opening 205.

To provide specific flow restrictions and tortuous paths through the wire segments 462 and 464, the width of each of the wire segments 462 and 464 may be modified. For instance, upper portion of the wire segment 462 may be configured to have a width x that is wider than a width y for the lower portion. With these widths, the straight opening 468 may be more resistant to erosion from particles, while still providing a fluid flow path. That is, the opening 468 formed between the rectangular portions of the wire segments 462 and 464 is narrower than the opening 470 between the keystone sections of the wire segments 462 and 464. As a specific example, the width x may be from about 0.005 millimeter (mm) to about 1 mm wider than the width y.

Further, the height of each of the wire segments 462 and 464 may also be modified to provide specific flow restrictions and tortuous paths through the pair of wire segments 462 and 464. For instance, the upper portion may be configured to have a height z, the middle portion may be configured to have a height q, and the lower portion may be configured to have a height w. To provide a more restrictive flow path through the wire segments 462 and 464, the height z of the upper portion may be longer than the heights q and w of the lower and middle portions. Alternatively, to provide larger volume flow paths, the heights q and w for the lower and middle portions may be increased to form larger channels between the wire segments 462 and 464.

Beneficially, in each of these embodiments, the wire segments provide redundant sand control along with additional flow paths through the wire segments. Indeed, the openings in the wire segments of FIGS. 4A, 4B and 4D utilize an inverse keystone geometry or partial inverse keystone geometry to minimize plugging, while the hyperboloidal pattern in FIG. 4C reduces plugging for injection flow paths. Further, because each embodiment includes uniquely shaped wire segments formed from a continuous segment of wire, a single wire-wrap process may be used to attach these wire segments to the axial rod. This single wire-wrap process may reduce costs by reducing multiple wrap processes steps in forming, e.g., the redundant sand control device.

As can be appreciated, the specific geometric patterns of the wire segments may include different variations, which still provide redundant sand control and additional flow paths through the wire segments. These geometric patterns may include different shapes that are designed to enhance operation in a specific direction, such as an injection well or a production well. Alternatively, the geometric patterns may also include shapes for operating in injection and production wells, as noted in FIG. 4C.

In addition to the specific geometric patterns of the wire segments, different types of wire segments may be utilized together to form partitions, compartments, and baffles that manage the flow of fluids within a wire-wrapped screen. As noted above, under the present techniques, wire segments of different types may also be used to provide redundancy, baffling (staggering), and compartmentalization for sand control with a wire-wrapped screen, such as sand control device 138. Thus, the wire segments 208, which may be a continuous wire or coupled individual wire segments, may be utilized to form channels having various combinations of curved, wavy or flat geometries. Accordingly, the channels formed by the wire segments are discussed in greater detail in FIGS. 5A-5G and 6A-6D.

FIGS. 5A-5G are exemplary embodiments of channels formed by wire segments in the sand control device of FIG. 1 in accordance with certain aspects of the present techniques. In this embodiment, which is herein referred to by reference numeral 500, the base pipe 202 is coupled to the axial rod 206 and wire segments 502-514, which may be examples of the wire segments 208*a*-208*n*. Each of the wire segments 502-514 may include a portion that is utilized to secure the wire segments to the axial rod 206, as discussed above. The wire segments 502-514 may also include different geometric patterns and various combinations of openings 520-540 to provide channels through the wire segments 502-514. For instance, openings 520, 524, 530, 534 and 538 may be design openings, while openings 522, 526, 528, 532, 536 and 540 may be restrictive openings.

In this embodiment, the wire segments 502-514 include three alternating patterns or shapes along a single wire. In particular, wire segments 502 and 504 have a first pattern, which includes a partial hyperboloidal portion stacked on a rectangular portion. Wire segments 506, 512 and 514 have a second pattern, which includes a rectangular portion, while wire segments 508 and 510 have a third pattern, which includes a rectangular portion, a partial hyperboloidal portion, and a keystone portion stacked on each other. The length of each wire segment shape may be varied, but for this example, each wire segment is at least two winding (wrapping) around the base pipe 202, which does not exceed one thousand feet for any wire segment.

Accordingly, in this configuration, the wire segments 502-514 form a first or outer screen layer formed by openings 520, 524, 528, 532, 536 and 540 and a second or inner screen layer formed by the openings 522, 526, 530, 534 and 538. The outer and inner screen layers provide a fluid flow path 541 to the central opening 205 or provide a fluid flow path 542 along a channel formed by the wire segments 502-514. Along the fluid flow path 542, fluid flows directly into the central opening 205 through a pair of wire segments 502-514. However, along this flow path 542, the different wire segments 502-514 create a helical or circumferential channel that forms a flow maze for fluids. The channel formed by these wire segments 502-514 may be more clearly understood by viewing FIGS. 5B-5G.

Figure 5A:
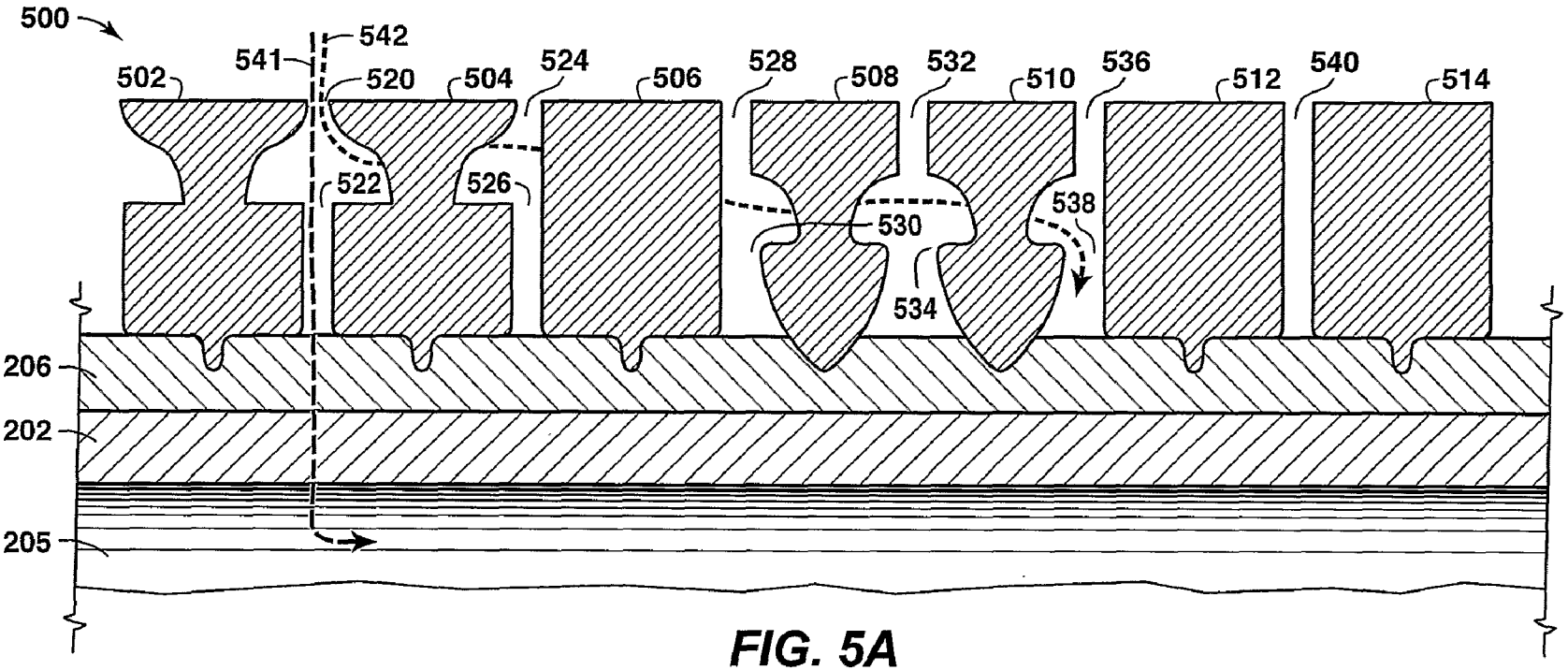
FIGS. 5A-5G are an exemplary embodiment of channels formed by wire segments in the sand control device of FIG. 1 in accordance with certain aspects of the present techniques.
Figures 5B, 5C, 5D, 5E, 5F, 5G:
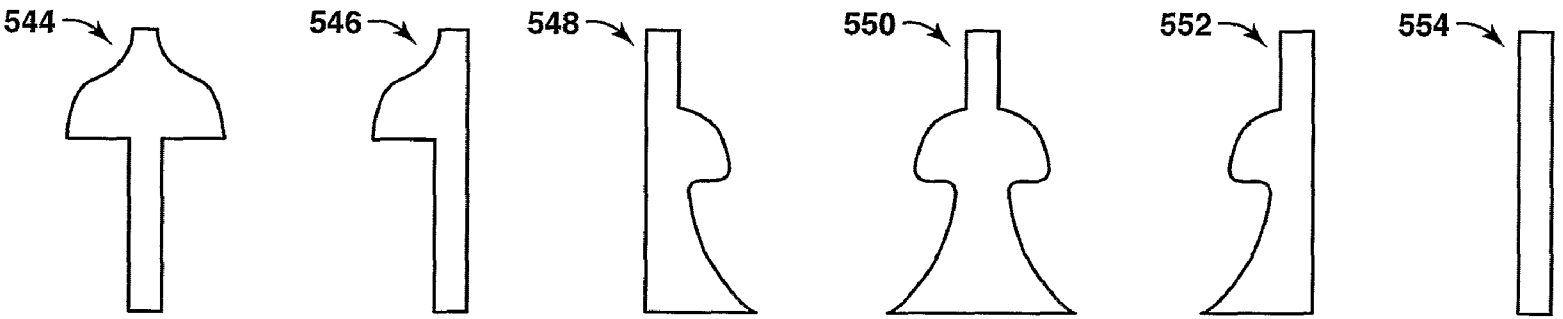

In FIGS. 5B-5G, the channel formed by the wire segments 502-514 is shown. In FIGS. 5B and 5E, inverse keystone channels 544 and 550 are formed between the wire segments 502 and 504 and wire segments 508 and 510, respectively. In FIGS. 5C, 5D and 5F, half-inverse keystone channels 546, 548 and 552 are formed between wire segments 504 and 506, wire segments 506 and 508, and wire segments 510 and 512, respectively. The flat sections of the channels 544, 546, 548, 550, and 552 are utilized to stagger the fluid flow, which may plug or restrictive flow with particles in the fluid. In FIG. 5G, a rectangular shaped channel 554 is formed between wire segments 512 and 514. This rectangular channel 554 forms a partition that blocks the flow path in the channel between the outer and inner screen layers. The rectangular channel 554 also forms a partition that blocks the helical flow path 542 in FIG. 5A.

During well production, fluid passing through one of the openings 520, 524, 528, 532, 536 and 540 in the outer screen layer flows along the channel between the wire segments 502-514 until exiting through one of the openings 522, 526, 530, 534 and 538 in the inner screen layer. However, when an opening in the outer screen layer, such as opening 520, is damaged, fluid and sand pass into the channel and follow the flow path 542. While fluid may enter the central opening 205 through openings 522, 526, 530, 534 and 538 in the inner screen layer, sand may continue along the flow path 542 to be blocked at the partition formed by wire segments 512 and 514. As the sand flows along the flow path 542, sand continues to dehydrate due to fluid loss or lose momentum (kinetic energy) due to the collision with the wire segments that form the channel walls. As a result, sand may accumulate and pack the channel along the flow path 542 to the eroded section of wire segments. That is, sand grains and particles may pack the channel to diminish or shut off fluid flow from the eroded opening in a self-mitigating manner. Thus, sand and fluid in the wellbore may be diverted to other openings in the wire segments that are intact and operating as designed to continue to produce hydrocarbons without interruption.

FIGS. 6A-6D are another exemplary embodiments of channels formed in wire segments in the sand control device 138 of FIG. 1 in accordance with certain aspects of the present techniques. In this embodiment, which is herein referred to by reference numeral 600, the base pipe 202 is coupled to the axial rod 206 and wire segments 602-608, which may be other examples of the wire segments 208*a*-208*n*. Each of the wire segments 602-608 may include a portion that is utilized to secure the wire segments to the axial rod 206 and include different geometric patterns, as discussed above. However, in this configuration, the openings 612-622 of the wire segments 602-608 may have more complex geometric patterns and may be configured to have extended restrictive openings. These extended restrictive openings, such as openings 614, 616, 620, and 622, provide additional mechanical strength and flow resistance to intensify the contrast between restrictive openings 614, 616, 620 and 622 and designing openings 612 and 618. Accordingly, the restrictive openings formed by these geometric patterns are more resistant to erosion.

In this embodiment, the wire segments 602-608 include three alternating geometric patterns in a single wire. In particular, wire segments 602 and 604 have a first pattern, wire segment 606 has a second pattern, and wire segment 608 has a third pattern. Each of these patterns is a unique geometric pattern that is utilized with an adjacent pattern to form an extended restrictive opening 614, 616, 620, or 622. Again, the length of each wire segment may be varied, but for this example, each wire segment 602-608 may be about at least two windings (wrapping) around the base pipe 202.

Accordingly, similar to the discussion above, the wire segments 602-608 form a first or outer screen layer, which is formed by openings 612, 616 and 620, and a second or inner screen layer, which is formed by openings 614, 618 and 622. The outer and inner screen layers provide a fluid flow path 623 to the central opening 205 or provide a fluid flow path 624 along a helical channel formed by the wire segments 602-608. Along the fluid flow path 623, fluid flow directly into the central opening 205 through the wire segments. However, due to the restriction in opening 614, the flow passing opening 612 may preferably follow flow path 624. Along flow path 624, the different wire segments 602-608 create a helical channel that forms a flow maze for fluids. The channel formed by these wire segments 602-608 may be more clearly understood by viewing FIGS. 6B-6D.

In FIGS. 6B-6D, the channel formed by the wire segments 602-608 is shown. In FIG. 6B, a trapezoidal channel 626 is formed between the wire segments 602 and 604. It is understood that the trapezoidal channel mimics an inverse keystone openings in FIGS. 4A-4D and 5A to minimize plugging by particles smaller than or equal to a specific size. In FIG. 6C, a partially rectangular channel 628 is formed between wire segments 604 and 606. Finally, in FIG. 6D, a narrow rectangular channel 630 is formed between wire segments 606 and 608. This rectangular channel 630 forms a partition that blocks the flow path between the outer and inner screen layers. The rectangular channel 630 also forms a partition that blocks the helical flow path 624.

During well production, fluid passing through one of the openings 612 and 616, but preferably opening 612, in the outer screen layer flows along the helical channel between the wire segments 602-608 until exiting through one of the openings 614, 618 or 622 in the inner screen layer. However, when an opening in the outer screen layer, such as opening 612, is damaged, fluid and sand pass into the channel and follow the flow path 624. While fluid may enter the central opening 205 through openings 614, 618 and 622 in the inner screen layer, sand may continue along the flow path 624 to be blocked at the partition formed by wire segments 606 and 608. As the sand flows along the flow path 624, sand continues to dehydrate due to fluid loss or lose momentum (kinetic energy) due to the collision with the wire segments 602-608 that form the channel walls. As a result, sand may accumulate and pack the channel along the flow path 624 to the eroded section of wire segments 602 and 604. That is, sand grains and particles may pack the channel to diminish or shut off fluid flow from the eroded opening 612 in a self-mitigating manner. Thus, sand and fluid in the wellbore may be diverted to other openings that are intact and operating as designed to continue to produce hydrocarbons without interruption.

Beneficially, various combinations of these wire segments in FIGS. 5A-6D may form channels that self-mitigate screen damage at any opening without well intervention. Accordingly, the different configurations provide redundant sand control with outer and inner screen layers, flow baffling within the helical channels and flow maze formed by the different wire segments, and compartmentalization by the partitions that isolate different helical flow paths in the wire segments. As such, specific combinations of these and other wire segments with different geometries may be utilized to provide compartments, baffles, and redundancy for sand control devices.

It should be noted that other combinations of wire segments may also be utilized. These other combinations may be based on the specific design desired reliability, productivity, production profile, accessibility, and other functional requirements for the well. For instance, the design of the compartments and baffles formed by the wire segments may depend on factors, such as manufacturing, materials, and/or locale of installation. The functional requirements may include, but are not limited to: exclusion of produced solids (sand control); improved mechanical strength or flexibility; exclusion or inclusion of specific fluids (downhole diversion and fluid conformance); delivery of treatment chemicals (for example, scale inhibitors, corrosion inhibitors, etc.); isolation of specific formation types; control of production rate or pressures; and/or measurement of fluid properties. Also, any number of wire segments may be combined to form channels or flow mazes.

Also, the number of compartments or baffles formed by the wire segments may be based on other design considerations. For instance, fewer compartments may enable larger compartment size and result in fewer redundant flow paths through the wire segments. On the other hand, an excessive number of compartments may decrease the compartment size, increase redundant flow paths, and increase manufacturing complexity. Similarly, a variation of compartments may also be utilized to provide specific functionality for certain intervals of a well. For baffles, the wire segments may include walls to completely or partially redirect fluid flow or change the fluid flow velocity. As such, the compartments or baffles may be formed within the wire segments to perform specific functions for the well.

Further, it should be noted that the present techniques may also be utilized for gravel packing. During gravel packing, the flow direction is similar to well production but gravel pack is continuously disposed around the screen. Accordingly, the wire segments may be configured to provide specific functionalities for gravel packing or may be designed to operate as both in gravel packing and well production.

Further, it should be noted that the present techniques may also be utilized for an injection well. During well injection, the flow direction is reversed, but the wire segments may function similar to well production. Accordingly, the wire segments may be configured to provide specific functionalities for an injection well or may be designed to operate as both an injection and production well.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. An apparatus associated with the production of hydrocarbons comprising:

a tubular member comprising:

a central opening within an internal portion of the tubular member, wherein the central opening allows hydrocarbons to flow through the tubular member; and a plurality of openings between the central opening and a region external to the tubular member; and at least two adjacent wire segments disposed around the tubular member, wherein the at least two adjacent wire segments create at least two flow paths to the central opening, and wherein at least one pair of adjacent wire segments forms at least two restrictive openings between the pair of adjacent wire segments, wherein the at least two restrictive openings are configured to prevent particles greater than a same specific size from passing through each of the at least two restrictive openings and entering the plurality of openings in the tubular member.

2. The apparatus of claim 1 wherein the at least two adjacent wire segments are configured to form baffles within at least one of the at least two flow paths.

3. The apparatus of claim 1 wherein the at least two adjacent wire segments are configured to form a compartment along at least one of the at least two flow paths.

4. The apparatus of claim 3 wherein the compartment prevents particles greater than a specific size from passing into the central opening.

5. The apparatus of claim 1 wherein the tubular member comprises a perforated base pipe.

6. The apparatus of claim 1 wherein at least one wire segment has a geometry different from a geometry of an adjacent wire segment to create different levels of flow maze and opening geometries along the tubular member.

7. The apparatus of claim 1 further comprising at least one shunt tube disposed between the tubular member and the at least two wire segments or between the at least two wire segments and the wellbore.

8. The apparatus of claim 1 wherein the apparatus is used for producing hydrocarbons or in injection operations.

9. The apparatus of claim 1 wherein the apparatus is used for gravel packing a well.

10. The apparatus of claim 1 comprising a plurality of rods disposed between the tubular member and the at least two adjacent wire segments.

11. The apparatus of claim 1 wherein each of the at least two adjacent wire segments have different geometric patterns.

12. The apparatus of claim 11 wherein the at least two adjacent wire segments form a compartment and at least one baffle along at least one of the at least two flow paths.

13. The apparatus of claim 1 wherein each of the at least two adjacent wire segments comprise a stacked keystone pattern.

14. The apparatus of claim 1 wherein the at least two adjacent wire segments comprise a first wire segment having a first pattern, a second wire segment having a second pattern, and a third wire segment having a third geometric pattern.

15. The apparatus of claim 14 wherein the first wire segment, second wire segment and third wire segment are disposed around the tubular member in alternating configurations.

16. The apparatus of claim 1 wherein the at least one pair of adjacent wire segments forms at least two restrictive openings and a design opening formed between the two adjacent wire segments.

17. The apparatus of claim 1, wherein said at least two restrictive openings comprise a first restrictive opening and a second restrictive opening, the second restrictive opening positioned closer to the central opening than the first restrictive opening, the second restrictive opening having an opening width that is not wider than the opening width of the first restrictive opening.

18. A sand control device comprising:

a plurality of wire segments disposed around a central opening, wherein at least two adjacent wire segments of the plurality of wire segments create at least one circumferential channel between the at least two adjacent wire segments and around the central opening, and wherein at least one pair of the at least two adjacent wire segments forms at least two restrictive openings between the pair of adjacent wire segments configured to prevent particles greater than a same specific size from passing through each of the at least two restrictive openings and entering the central opening.

19. The sand control device of claim 18 wherein the plurality of wire segments are configured to form baffles within the at least one circumferential channel.

20. The sand control device of claim 18 wherein the at least two adjacent wire segments are configured to form a compartment in the at least one circumferential channel.

21. The sand control device of claim 18 wherein the at least one pair of wire segments forms different combinations of design openings and restrictive openings to baffle fluid flowing into the at least one circumferential channel.

22. The sand control device of claim 18 comprising a perforated base pipe within the plurality of wire segments, wherein the perforated base pipe has a plurality of openings between the central opening and a region external to the perforated base pipe.

23. The sand control device of claim 22 further comprising at least one shunt tube disposed between the perforated base pipe and the plurality of wire segments or between the plurality of wire segments and the wellbore.

24. The sand control device of claim 22 comprising a plurality of rods disposed between the perforated base pipe and the plurality of wire segments.

25. The sand control device of claim 18 wherein the sand control device is used for producing hydrocarbons.

26. The sand control device of claim 18 wherein at least two adjacent wire segments of the plurality of wire segments have different geometric patterns.

27. The sand control device of claim 18 wherein the at least two adjacent wire segments comprise a first wire segment having a first pattern, a second wire segment having a second pattern, and a third wire segment having a third geometric pattern.

28. The sand control device of claim 27 wherein the first wire segment, second wire segment and third wire segment are disposed around the central opening in alternating configurations.

29. The sand control device of claim 18 wherein the at least one pair of adjacent wire segments further forms at least one design opening between the pair of adjacent wire segments.

30. The sand control device of claim 18, wherein said at least two restrictive openings comprise a first restrictive opening and a second restrictive opening, the second restrictive opening positioned closer to the central opening than the first restrictive opening, the second restrictive opening having an opening width that is not wider than the opening width of the first restrictive opening.

31. A system associated with production of hydrocarbons comprising:

a wellbore utilized to produce hydrocarbons from a subsurface reservoir;

a production tubing string disposed within the wellbore;

at least one sand control device coupled to the production tubing string and disposed within the wellbore, the at least one sand control device comprising a plurality of wire segments disposed around a central opening, wherein at least one pair of adjacent wire segments of the plurality of wire segments creates a circumferential channel between the at least one pair of adjacent wire segments and around the central opening; and wherein the at least one pair of adjacent wire segments forms at least two restrictive openings between the pair of adjacent wire segments to prevent particles greater than a same specific size from passing through each of the at least two restrictive openings and entering the central opening.

32. The system of claim 31 wherein the plurality of wire segments are configured to form baffles within the at least one circumferential channel.

33. The system of claim 31 wherein the plurality of wire segments are configured to form a compartment in the at least one circumferential channel.

34. The system of claim 31 comprising a perforated base pipe within the plurality of wire segments, wherein the perforated base pipe has a plurality of openings between the central opening and a region external to the perforated base pipe and is coupled to the production tubing string.

35. The system of claim 34 further comprising at least one shunt tube disposed between the perforated base pipe and the plurality of wire segments or between the plurality of wire segments and the wellbore.

36. The system of claim 34 further comprising a tree coupled to the production tubing string and disposed above the wellbore.

37. The system of claim 34 further comprising a floating production facility coupled to the tree and utilized to produce hydrocarbons from the subsurface reservoir.

38. A method associated with production of hydrocarbons comprising:

providing a sand control device having a plurality of wire segments disposed around a central opening, wherein at least one pair of adjacent wire segments of the plurality of wire segments creates a circumferential channel between the at least one pair of adjacent wire segments and around the central opening; and wherein a pair of adjacent wire segments form at least two redundant restrictive openings between the pair of adjacent wire segments configured to prevent particles greater than a same specific size from passing through each of the at least tow restrictive openings and entering the central opening; and disposing the sand control device within a wellbore.

39. The method of claim 38 comprising disposing a perforated base pipe within the plurality of wire segments, wherein the perforated base pipe has a plurality of openings between the central opening and a region external to the perforated base pipe.

40. The method of claim 39 comprising disposing at least one shunt tube between the plurality of wire segments and the perforated base pipe or between the plurality of wire segments and the wellbore.

41. The method of claim 38 comprising gravel packing around the sand control device within the wellbore.

42. The method of claim 38 comprising producing hydrocarbons from a subsurface formation via the sand control device.

43. The method of claim 38 wherein each of the adjacent wire segments of the at least one pair of adjacent wire segments have different geometric patterns with respect to the other of the at least one pair of adjacent wire segments.

44. The method of claim 38 comprising injecting fluids into the wellbore via the sand control device.

45. A method of manufacturing a sand control device comprising:

forming wire segments; and wrapping the wire segments around a central opening in a single wrap process, wherein at least one pair of adjacent wire segments create a circumferential channel between the at least one pair of adjacent wire segments and around the central opening; and wherein at least one pair of adjacent wire segments are configured to prevent particles greater than a same specific size from entering the central opening.

46. The method of claim 45 comprising wrapping the wire segments around a plurality of rods disposed around the central opening.

47. The method of claim 46 comprising welding the wire segments to the plurality of rods.

48. The method of claim 47 comprising disposing the wire segments around a perforated base pipe, wherein the perforated base pipe has a plurality of openings between the central opening and a region external to the perforated base pipe.

49. The method of claim 48 comprising slipping wire segments welded on plurality of rods onto the perforated base pipe.

50. The method of claim 48 comprising welding metal rings to opposite ends of at least one of the perforated base pipe, the wire segments, the plurality of rods, and any combination thereof.

51. The method of claim 45, wherein said at least one pair of adjacent wire segments form at least two restrictive openings comprising a first restrictive opening and a second restrictive opening, the second restrictive opening positioned closer to the central opening than the first restrictive opening, the second restrictive opening having an opening width that is not wider than the opening width of the first restrictive opening.

* * * * *